US007604583B2

(12) United States Patent
Denisco

(10) Patent No.: US 7,604,583 B2
(45) **Date of Patent: *Oct. 20, 2009**

(54) STRETCHING MACHINE

(76) Inventor: Christopher R. Denisco, 325 Greenwood Dr., Key Biscayne, FL (US) 33149

( * ) Notice: Subject to any disclaimer, the term of this patent is extended or adjusted under 35 U.S.C. 154(b) by 0 days.

This patent is subject to a terminal disclaimer.

(21) Appl. No.: 11/738,767

(22) Filed: Apr. 23, 2007

(65) Prior Publication Data

US 2008/0032877 A1 Feb. 7, 2008

Related U.S. Application Data

(63) Continuation-in-part of application No. 11/203,705, filed on Aug. 15, 2005, now Pat. No. 7,476,182.

(51) Int. Cl.
*A63B 26/00* (2006.01)

(52) U.S. Cl. ..... 482/145; 482/142

(58) Field of Classification Search ..... 482/907, 482/91

See application file for complete search history.

(56) References Cited

U.S. PATENT DOCUMENTS

| | | | | |
|---|---|---|---|---|
| 3,285,070 | A | 11/1966 | Wilmot | |
| 3,845,945 | A * | 11/1974 | Lawley et al. | 5/602 |
| 4,226,415 | A | 10/1980 | Wright | |
| 4,602,618 | A | 7/1986 | Berze | |
| 5,067,709 | A | 11/1991 | Christianson | |
| 5,232,427 | A | 8/1993 | Paro | |
| 5,277,681 | A | 1/1994 | Holt | |
| 5,364,326 | A | 11/1994 | Smith et al. | |
| 5,405,306 | A | 4/1995 | Goldsmith et al. | |
| 5,480,375 | A | 1/1996 | La Fosse et al. | |
| 5,498,222 | A * | 3/1996 | Hur | 482/112 |
| 5,558,607 | A | 9/1996 | Darling | |
| 5,634,873 | A | 6/1997 | Carlstrom | |
| 5,662,592 | A | 9/1997 | Brady | |
| 5,730,706 | A | 3/1998 | Garnies | |
| 5,882,083 | A * | 3/1999 | Robinson | 297/440.2 |
| 5,913,759 | A | 6/1999 | Bostrom | |
| 5,938,573 | A | 8/1999 | Davies, III et al. | |
| 5,938,574 | A | 8/1999 | Webber | |
| 5,984,845 | A | 11/1999 | Powers | |
| 6,019,740 | A | 2/2000 | Hausman | |
| 6,422,981 | B1 | 7/2002 | Riser | |
| 6,547,705 | B2 | 4/2003 | Yu | |
| 2004/0169411 | A1 * | 9/2004 | Murray | 297/486 |
| 2007/0225136 | A1 | 9/2007 | Roman et al. | |

* cited by examiner

*Primary Examiner*—Lori Amerson
(74) *Attorney, Agent, or Firm*—Brian J. Colandreo; Elizabeth R. Burkhard; Holland & Knight LLP

(57) ABSTRACT

A stretching machine includes a bench having at least one base members. A cam is coupled to the base member or one of the base members, if there is more than one. A stretching arm is coupled to the cam at one end and has an extremity attachment device at its other end. An actuator is coupled to at least one of the base members and is coupled to the cam. The actuator enables movement of the cam and the movement of the cam enables movement of the stretching arm. There is a control mechanism for controlling the actuator.

13 Claims, 2 Drawing Sheets

STRETCHING MACHINE

RELATED APPLICATIONS

This application is a continuation-in-part of U.S. patent application Ser. No. 11/203,705, filed 15 Aug. 2005, now U.S. Pat. No. 7,476,182 entitled "Horizontal Hamstring Stretcher", the entire disclosure of which is herein incorporated by reference.

TECHNICAL FIELD

This disclosure relates to stretching machines, and more particularly to an improved hamstring and shoulder stretcher.

BACKGROUND

Stretching one's muscles before and after physical activity has long been recommended by doctors and other health professionals as being important for preventing injury and improving flexibility. While many exercise and weight lifting machines exist on the market today, there are not many stretching machines available that can aid a user in safely stretching some of the harder to stretch muscle groups, such as hamstrings and shoulder muscles. There exists a need for a stretching machine that will aid a user in stretching with a low risk of injury.

SUMMARY

In a first embodiment, a stretching machine includes a bench having at least one base member. A cam is coupled to the base member or one of the base members, if there is more than one. A stretching arm has a first end that is coupled to the cam. The stretching arm has a second end, which has an extremity attachment device. An actuator is coupled to the base member and the cam, such that the actuator enables movement of the cam, which enables movement of the stretching arm. The functioning of the actuator is controlled by a control mechanism.

One or more of the following features may be included. In some embodiments, the stretching machine also includes a stretching arm support member. The stretching arm support member may be a piston in certain embodiments. In some embodiments, the stretching arm support member may be pivotally attached to the bench.

In certain embodiments, the extremity attachment device is adjustably coupled to the second end of the stretching arm. The extremity attachment device may be a u-shaped harness, a hook and loop fastener, a circular harness or a similar attachment device.

In some embodiments, the stretching arm is pivotally coupled to the cam. In some embodiments, the cam is pivotally coupled to the base member or one of the base members, if there is more than one. In certain embodiments, the actuator includes a motor. In some embodiments, the actuator is a pneumatic piston.

In certain embodiments, the control mechanism is electronically hard wired and controls the operation of the actuator. In some embodiments, the operation of the actuator is controlled by a wireless control device.

In some embodiments, the stretching machine includes a strap for securing a non-stretching leg or arm of a user to the bench. The strap may include a hook and loop-type fastener to tighten and hold the strap in place.

The details of one or more embodiments are set forth in the accompanying drawings and the description below. Other features and advantages will become apparent from the description, the drawings and the claims.

DETAILED DESCRIPTION OF EXEMPLARY EMBODIMENTS

Figure 1:
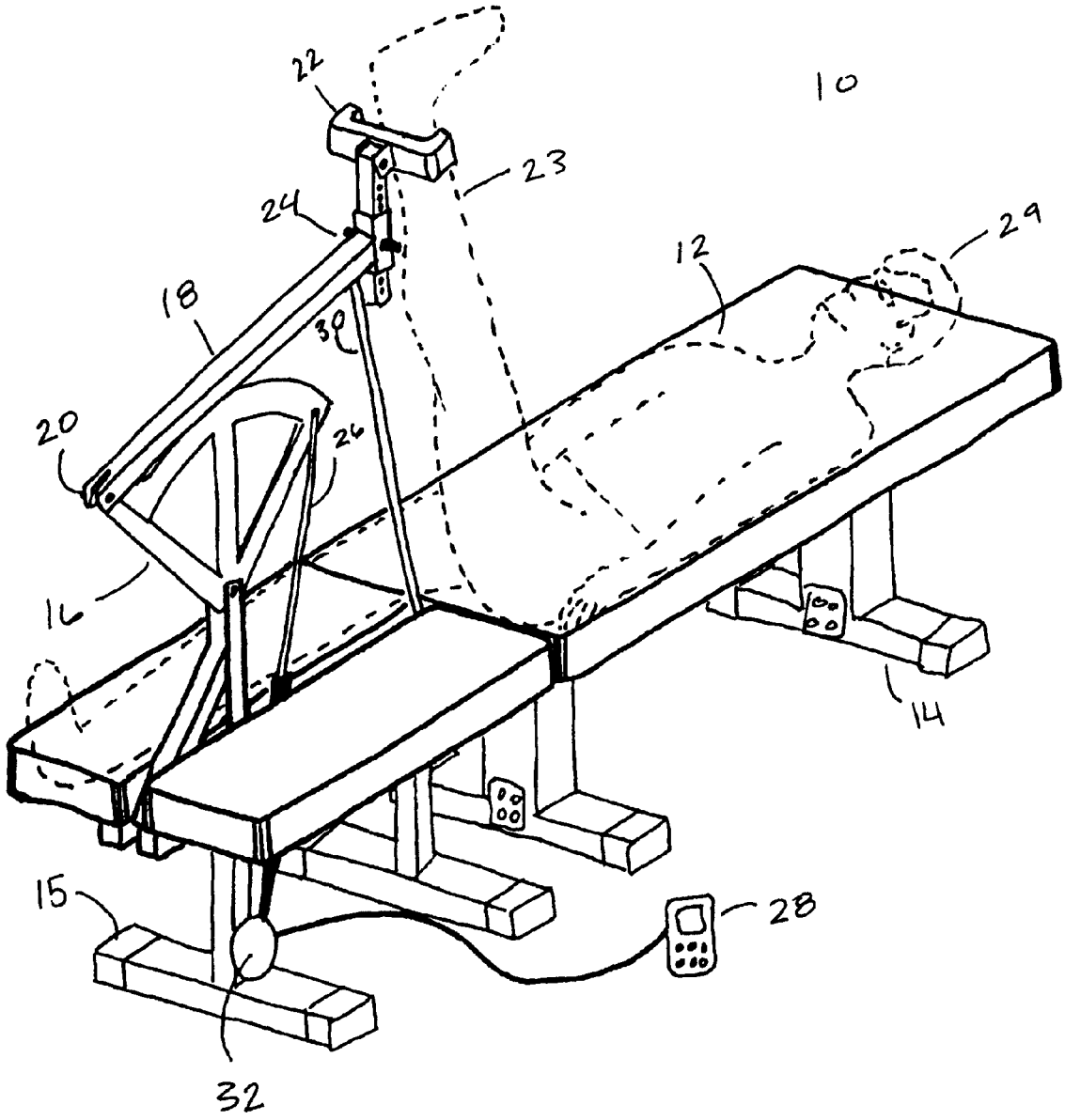
FIG. 1 is a perspective view of an embodiment of the present stretching machine.

Referring to FIG. 1, an embodiment of a stretching machine 10 is shown. The stretching machine 10 may include a bench 12 for a user to lie or sit on. The bench 12 may be supported by one or more supports or base members, such as the two depicted base members 14, 15. The stretching machine 10 may also include a cam 16 that may be coupled to and supported by at least one base member 14. The cam 16 may be coupled to a stretching arm 18 at a first end 20. A second end 24 of the stretching arm 18 may include an extremity attachment device 22, which may be configured to secure an extremity 23, such as an arm, an elbow, a wrist, a foot, an ankle or a calf/lower leg, to the stretching arm 18. The stretching machine 10 may further include an actuator 26 that may be disposed between, and may be coupled to, the at least one base member 14 and the cam 16. Operation of the actuator 26 may control the movement of the cam 16, which may in turn control the movement of the stretching arm 18. A control mechanism 28 may control the operation of the actuator 26 so that a user 29 may control the movement of the stretching arm 18.

The stretching machine 10 may also include a stretching arm support member 30. The stretching arm support member 30 may provide support to the second end 24 of the stretching arm 18. The stretching arm support member 30 may, at least in part, maintain the stretching arm 18 in an elevated position and may prevent the stretching arm from moving laterally. In this manner, the stretching arm support member 30 may allow the stretching arm 18 to move in response to the operation of the actuator 26, and may allow the stretching arm 18 to move in an essentially horizontal plane when the stretching machine 10 is in the depicted orientation. In one embodiment the stretching arm support member 30 may be a piston. Furthermore, the stretching arm support member 30 may be pivotally coupled to the bench 12 such that it may move back and forth with the movement of the stretching arm 18.

The extremity attachment device 22 may be adjustably coupled to the second end 24 of the stretching arm 18. That is, the adjustable coupling of the extremity attachment device 22 relative to the second end 24 of the stretching arm 18 may enable positioning of the extremity attachment device 22 along the stretching arm to accommodate the height and orientation of a user's 29 leg. The extremity attachment device 22 may include a variety of different structures or configurations. For example, the extremity attachment device 22 may include a unshaped harness, a hook and loop fastener, a circular harness, a foot rest, a foot harness, an arm rest, a wrist harness, or similar structures, which may be configured to secure at least a portion of a user's 29 extremity 23 to the stretching arm 18.

Figure 2:
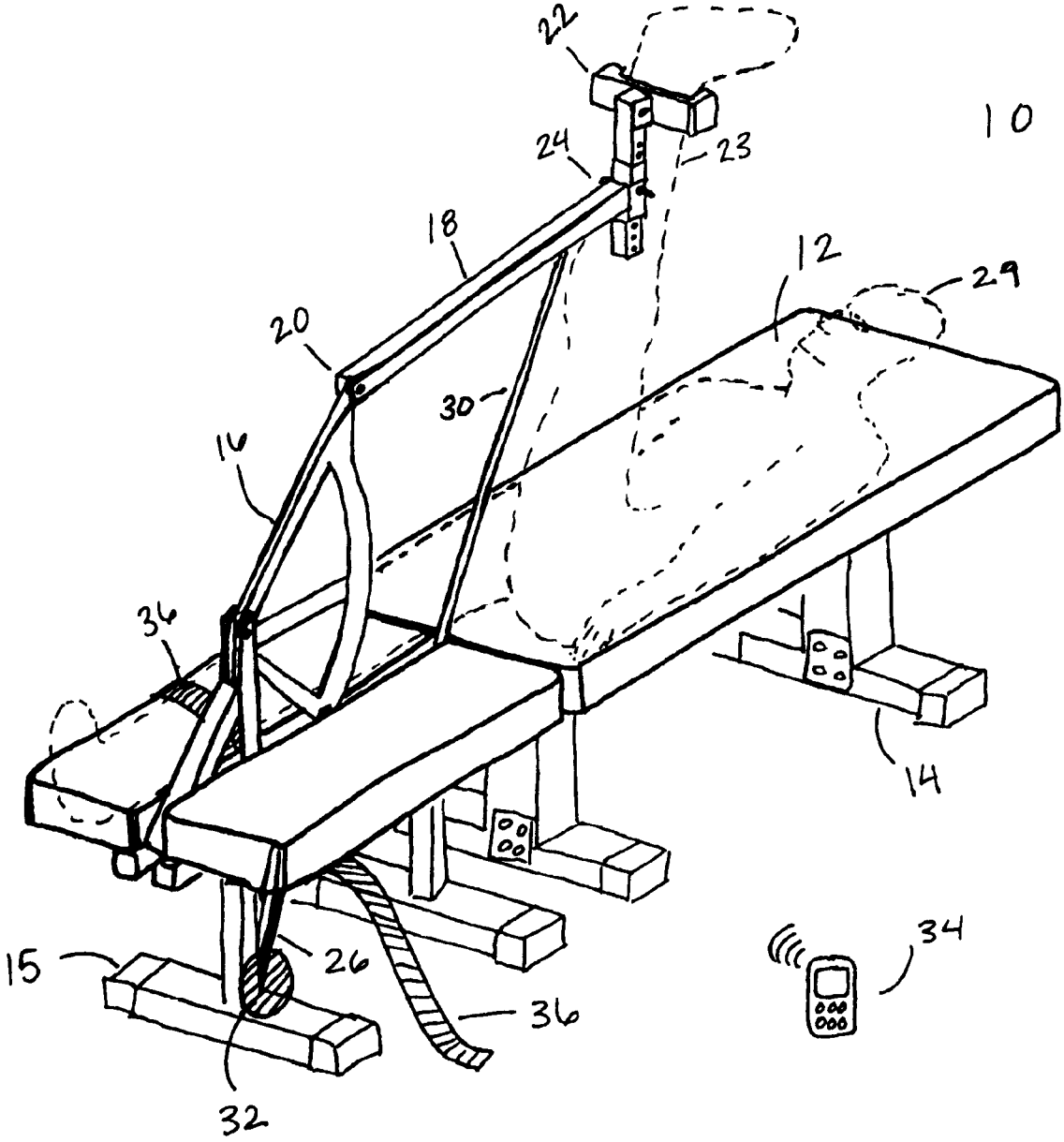
FIG. 2 is a perspective view of the stretching machine of FIG. 1, with the stretching arm in the extended position.

Referring also to FIG. 2, the first end 20 of the stretching arm 18 may be pivotally coupled to the cam 16. The pivotal coupling may enable the stretching arm 18 to extend away from the cam 16 as the actuator 26 moves the cam 16 downward. Similarly, the cam 16 may be pivotally coupled to at least one base member 14 such that the cam 16 may have a generally semi-circular range of motion for moving the stretching arm 18 between an extended position and back to an at-rest position.

The actuator may include a driving device, such as an electric motor 32. In other embodiments, the actuator 26 may include a pneumatic piston or a similar device suitable for moving the cam 16 and stretching arm 18. The control mechanism 28 may electronically control the operation of the actuator 26, e.g., by transmitting commands from a user 29 to the driving device 32. The control mechanism 32 may be coupled to the actuator, e.g., via a hardwired connection, or may be a remote control 34, e.g., utilizing an radio or infrared communication channel, for remotely or wirelessly controlling the operation of the actuator 26.

The stretching machine 10 may also include a strap 36 that may aid in keeping the user's 29 body flat on the bench 12, or otherwise held in position relative to the bench. For example, the strap 36 may allow the user's non-stretching leg, torso, or waist, to be secured to the bench 12. Maintaining the user 29 in position relative to the bench 12 may allow better stretching, e.g., of the hamstring muscles in the stretching leg. The strap 36 may include securement features, e.g., hook and loop-type fastener or friction buckles, for ease of use.

A user 29 desiring to stretch his hamstring muscles using the stretching machine 10 may begin with the stretching arm 18 in the at-rest position, as shown in FIG. 1. After securing or resting his or her lower leg or ankle to the extremity attachment device 22, the user 29 may lie flat and facing upward on the bench 12. The user 29 may also secure his non-stretching leg to the bench 12 using the strap 36. The control mechanism 28 or 34 may be used to operate the actuator 26, which may in turn move the cam 16 downward, thereby moving the stretching arm 18 into an extended position, as shown in FIG. 2. The rate of operation of the actuator 26, and thereby the cam 16 and stretching arm 18, may be controlled to provide safe operation, e.g., by relatively slowly moving the stretching arm 18 from the at-rest position toward the extended position. As the cam 16 moves the stretching arm 18 into the extended position, the user 29 may feel tension in his hamstring muscle. The user 29 may then decide when to stop the extending of the stretching arm 18 depending on his level of comfort. The stretching arm 18 may be held in the extended position or returned to the at rest position according to the user's 29 control through the control mechanism 28, 34.

In a related manner, a user 29 desiring to stretch his shoulder muscles with the stretching machine 10 may begin with the stretching arm in the at rest position, as shown in FIG. 1. After securing or resting his or her arm or elbow to the extremity attachment device 22, the user 29 may sit on the bench 12 at an angle to the stretching arm 18. The control mechanism 28 or 34 may be used to operate the actuator 26, moving the cam 16 downward, thereby moving the stretching arm 18 slowly into an extended position, as shown in FIG. 2. As the cam 16 moves the stretching arm 18 into the extended position, the user 29 may feel tension in his upper arm and shoulder. The user 29 may decide when to stop the movement of the stretching arm 18 depending on his level of comfort. The user 29 may hold the stretching arm 18 in the extended position or return the stretching arm 18 to the at rest position using the control mechanism 28, or 34.

A number of implementations have been described. Never the less, it will be understood that various modifications may be made. Accordingly, other implementations are within the scope of the following claims.

What is claimed is:

1. A stretching machine for a user in an adjustable supine position comprising:

a bench having at least one base member for supporting a user;

a cam having a semi-circular range of motion coupled to the base member;

a stretching arm having a first end coupled to the cam and a second end coupled to an extremity attachment device;

an actuator coupled to the base member and coupled to the cam, the actuator enabling movement of the cam, the movement of the cam enabling movement of the stretching arm in a variable arc relative to the bench while pushing and stretching a user's leg arcuately;

a stretching arm support member;

and a control mechanism for controlling the actuator.

2. The stretching machine of claim 1, wherein the stretching arm support member is a piston.

3. The stretching machine of claim 1, wherein the stretching arm support member is pivotally coupled to the bench.

4. The stretching machine of claim 1, wherein the extremity attachment device is adjustably coupled to the second end of the stretching arm.

5. The stretching machine of claim 1, wherein the extremity attachment device is selected from the group consisting of a u-shaped harness, a hook and loop fastener, a circular harness, a foot rest, a foot harness, an arm rest, and a wrist harness.

6. The stretching machine of claim 1, wherein the stretching arm is pivotally coupled to the cam.

7. The stretching machine of claim 1, wherein the cam is pivotally coupled to the base member.

8. The stretching machine of claim 1, wherein the actuator includes a motor.

9. The stretching machine of claim 1, wherein the actuator is a pneumatic piston.

10. The stretching machine of claim 1, wherein the control mechanism electronically controls operation of the actuator.

11. The stretching machine of claim 1, wherein the control mechanism remotely controls operation of the actuator.

12. The stretching machine of claim 1 further comprising a strap for securing a non-stretching leg of a user to the bench.

13. The stretching machine of claim 12, wherein the strap comprises a hook and loop fastener.

* * * * *